US006378401B1

(12) United States Patent
Lordahl et al.

(10) Patent No.: US 6,378,401 B1
(45) Date of Patent: Apr. 30, 2002

(54) COMBINATION SHUTOFF VALVE WRENCH

(75) Inventors: Var Lordahl, 1571 Shaefer Rd., Long Grove, IL (US) 60047; Scott Koepsell, Waukegan, IL (US)

(73) Assignee: Var Lordahl, Long Grove, IL (US)

( * ) Notice: Subject to any disclaimer, the term of this patent is extended or adjusted under 35 U.S.C. 154(b) by 0 days.

(21) Appl. No.: 09/523,942

(22) Filed: Mar. 13, 2000

(51) Int. Cl.[7] ..... B25B 13/06
(52) U.S. Cl. ..... 81/124.4; 81/124.2
(58) Field of Search ..... 81/124.4, 120, 81/121.1, 124.2, 124.6, 125.1, 176.1, 176.15, 176.2, 3.4

(56) References Cited

U.S. PATENT DOCUMENTS 151,635 A * 6/1874 Uhlinger et al. ..... 81/124.4 X
2,605,665 A * 8/1952 Grenat ..... 81/125.1 X
3,635,106 A * 1/1972 Homs ..... 81/124.6
3,877,327 A * 4/1975 Erm ..... 81/124.4
3,878,740 A * 4/1975 Gutshall ..... 81/124.6
5,862,721 A * 1/1999 Kowats ..... 81/121.1

* cited by examiner

*Primary Examiner*—D. S. Meislin
(74) *Attorney, Agent, or Firm*—Kajane McManus

(57) ABSTRACT

The combination shutoff valve wrench accommodates engagement of a plurality of common valve handle configurations and a plurality of common valve stem broach configurations and is adapted for manipulation by hand or by use of a ratchet or extension therefor.

11 Claims, 2 Drawing Sheets

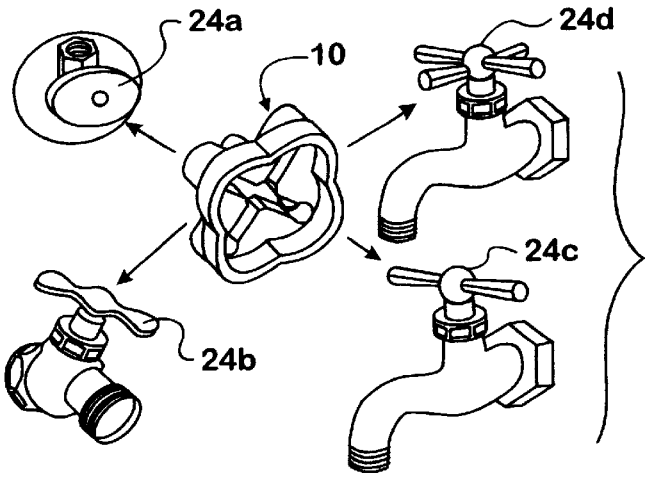
FIG. 3
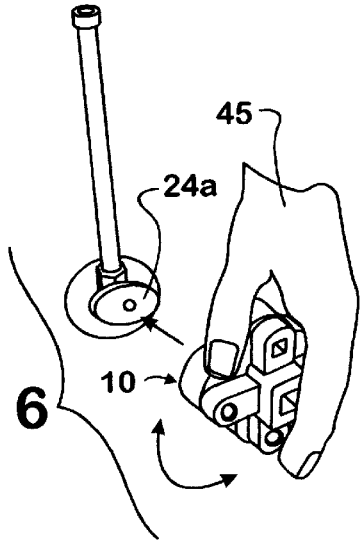
FIG. 6
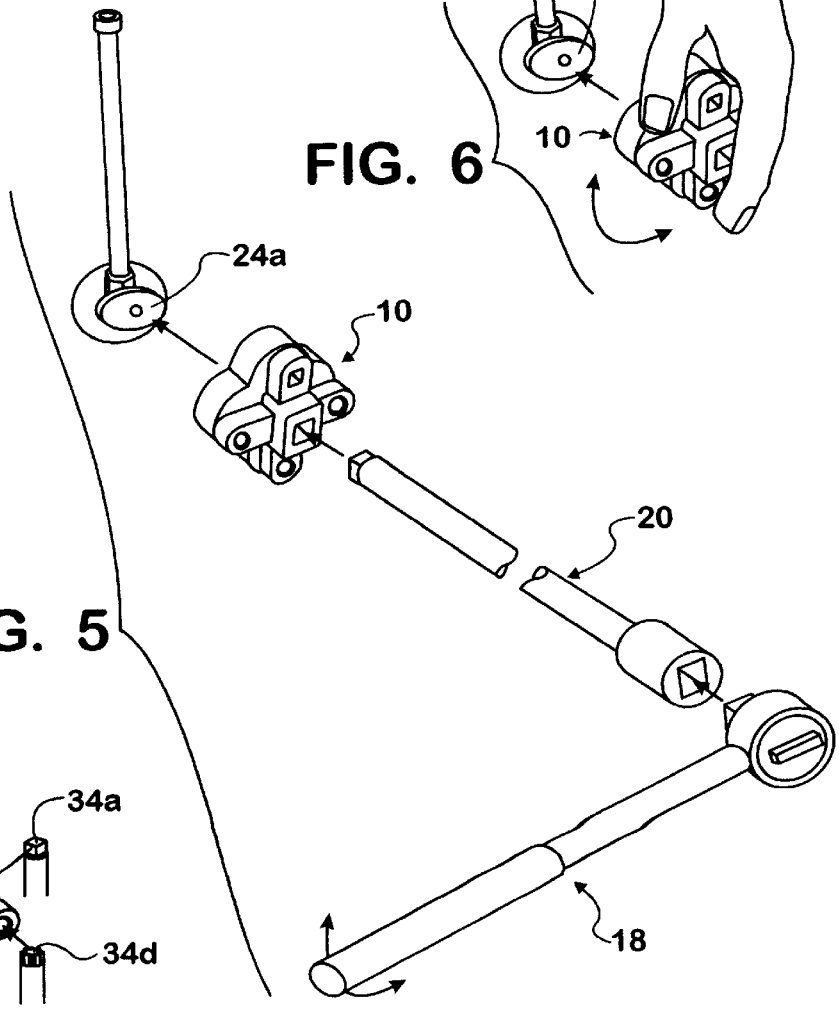
FIG. 5
FIG. 4
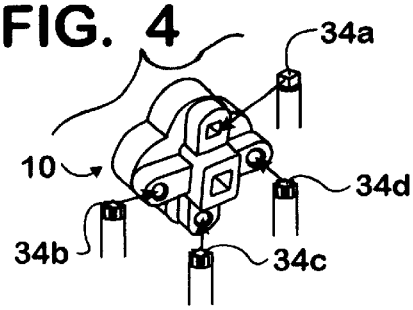

COMBINATION SHUTOFF VALVE WRENCH

SUMMARY OF THE INVENTION

According to the invention there is provided a combination shutoff valve wrench for use in manipulating a valve handle and a valve stem without a valve handle, the wrench accommodating engagement of a plurality of valve handle configurations, a plurality of valve stem configurations and a ratchet.

BACKGROUND OF THE INVENTION

1. Field of Invention

The present invention relates to a combination shutoff valve wrench. More particularly, the wrench accommodates a plurality of valve handles found on plumbing valves, a plurality of valve stem broaches in cases where the handle is missing either a ratchet or an extension thereof, and may be manipulated by hand as well, if desired.

2. Background of the Invention

Plumbing valves are commonly recessed in awkward and/or hard to reach locations. Because of their shape and propensity to breakage during manipulation by hand, such manual manipulation is one major cause of a common injury to tendons in the hand, commonly referred to as a "trigger finger".

Heretofore, a wrench for use in accommodating a single type of valve handle has been proposed.

Also, tools have been available for engaging a single embodiment of a valve stem broach.

And, tools have been provided which can be engaged to a ratchet or extension thereof.

However a single tool for accommodating all the above is absent in the art.

BRIEF DESCRIPTION OF THE DRAWING

FIG. 3 is a perspective view of the wrench together with a showing of various shaped exemplary valve handles it accommodates.

FIG. 4 is a perspective view of the wrench together with a showing of the various shaped exemplary valve stem broaches it accommodates.

FIG. 5 shows the wrench used with a ratchet and/or extension to engage a valve handle.

FIG. 6 shows the wrench being manipulated by hand to engage a valve handle.

DESCRIPTION OF THE PREFERRED EMBODIMENT

Figure 1:
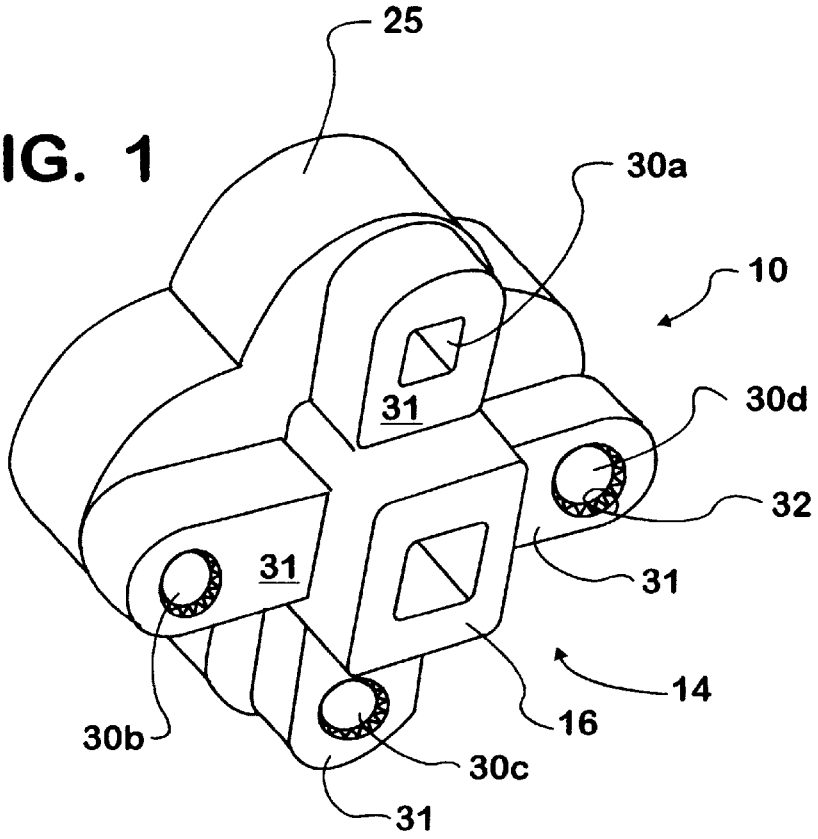
FIG. 1 is a perspective view of a valve stem broach accommodating surface of the wrench.
Figure 2:
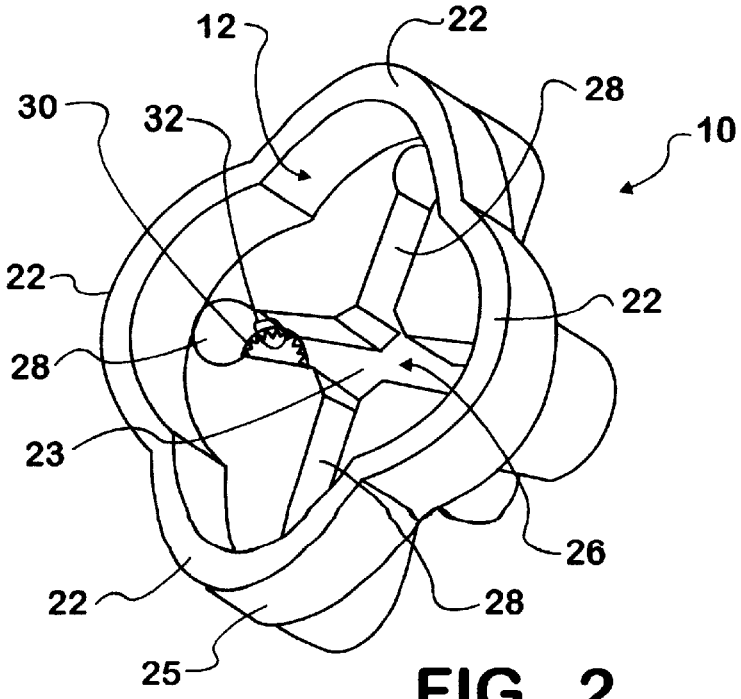
FIG. 2 is a perspective view of a valve handle accommodating surface of the wrench.

Referring now to the drawings in greater detail, there is illustrated therein a combination shutoff valve wrench made in accordance with the teachings of the present invention and generally identified by the reference numeral 10.

As shown, the wrench 10 is tiered and includes a recessed valve handle engaging surface 12, one oppositely extended valve broach engaging surface 14 and a center hub 16 extending outwardly of the valve stem broach engaging surface 14 adapted to engage a ratchet 18 or extension 20 therefor.

Beginning with the valve handle engaging surface 12, it will be seen to be recessed, having four recessed lobes 22 extending equilaterally from a centerpoint 23 of the wrench 10 which are surrounded by a continuous edge wall 25. The recessed lobes 22 are configured to accommodate valve handles such as handles 24*a* and 24*b* shown in FIG. 3. A further recess 26 is provided in a bottom wall 28 of the lobes 22 for accommodating graspability of a different embodiment of a handle, such as handle 24*b* shown in FIG. 3. The recess 26 is shown to comprise four channels 28 fanning radially outwardly from the centerpoint 23, equidistantly spaced from one another for accommodating valve handles such as 24*c* and 24*d* illustrated in the Figure. It will be understood that any plurality of valve handles substantially similar to those shown in FIG. 3 will also be accommodated by the recessed valve handle engaging surface 12.

Turning now to the valve stem broach engaging surface 14, it will be seen that a port 30 is drilled through each bottom surface 31 defining each channel 28. Each port 30 has a peripheral edge 32 configured to snugly engage a particular embodiment of a valve stem broach. As illustrated in FIG. 4, valve stem broaches are configured in a plurality of embodiments. Port 30*a* accommodates a square valve stem broach 34*a*, port 30*b* accommodates a hexagonal valve stem broach 34*b*, port 30*c* accommodates a twelve point valve stem broach 34*c*, and port 30*d* accommodates an eighteen point valve stem broach or 34*d*. This particular plurality of ports 30 should not be construed as limiting.

Extending outwardly of the broach engaging surface 14 is the center hub 16, forming a third level or tier to the wrench 10. The hub 16 is in the form of a collar 16 which is centered and which is sized and configured to functionally engage a ratchet 18 or extension 20 therefor.

The collar 16 is provided for adaptability of the wrench 10 for use in situations where either the valve handle or the valve stem broach are not easily accessible by hand, allowing for use of the extension 20, as illustrated in FIG. 5. Further, where the valve handle may not be easily manipulated, the collar 16 allows for engagement of the wrench 10 directly to the ratchet 18, for applying leverage against the valve handle to loosen same.

In a preferred embodiment, the collar 16 is configured to engage a ⅜ inch ratchet, though this is not to be construed as limiting.

Further, as illustrated in FIG. 6, the wrench 10 is configured to be easily manipulated by hand 45, for engaging a valve stem broach for which a valve handle is not available, or alternatively, for use in loosening a valve handle which is "stuck" by allowing for additional torque to be applied thereagainst by the hand 45 of the user.

Also, the wrench 10 is relatively small, easily carried in a pocket and is lightweight for convenience.

The continuous edge wall 25 defining the lobes 22 provides for graspability of the wrench 10 as well as providing a surface along the lobes 22 against which thumb pressure may be applied if necessary to coax rotational motion. Further, the possibility of a "trigger finger" type injury is substantially reduced if not altogether eliminated by use of the wrench.

As described above, the wrench 10 provides a number of advantages, some of which have been described above and others of which are inherent in the invention. Also, modifications may be proposed to the wrench 10 without departing from the teachings herein. Accordingly, the scope of the invention is only to be limited as necessitated by the accompanying claims.

What is claimed is:

1. A combination wrench for use in manipulating a valve handle or a valve stem, the wrench having multiple tiers and including a first hollow surface, the hollow surface being defined by and within the multiple tiers and being configured to functionally engage any one of a plurality of valve handle configurations, and a second opposite surface having a plurality of differently configured ports therein for accommodating functional engagement of any of a plurality of valve stem broach configurations and for accommodating functional engagement of a ratchet.

2. The wrench of claim 1 wherein said multiple tiers comprise two valve handle engaging tiers and said wrench further including a hub tier.

3. The wrench of claim 2 wherein the hub tier comprises an elevated centered collar having a port therein sized and configured to engage a ratchet style wrench and extensions.

4. The wrench of claim 2 wherein a first tier of the two valve handle engaging tiers comprises a plurality of hollow radially arrayed arms.

5. The wrench of claim 4 wherein each of the plurality of arms is equidistantly spaced from adjacent arms.

6. The wrench of claim 5 wherein each of the plurality of arms includes one of said differently configured ports therein for functionally engaging a correspondingly configured valve stem.

7. The wrench of claim 4 wherein a second tier of the two valve handle engaging tiers comprises a plurality of hollow radially arrayed lobes.

8. The wrench of claim 7 wherein a hollow radially arrayed arm overlies each hollow radially arrayed lobe to create the hollow surface within which any of a plurality of a differently configured valve handles can be functionally engaged.

9. The wrench of claim 8 wherein the hollow radially arrayed arms extend outwardly and downwardly from the elevated centered collar.

10. The wrench of claim 9 wherein the hollow radially arrayed lobes extend downwardly from the hollow radially arrayed arms.

11. The wrench of claim 9 wherein the elevated centered collar is defined by a continuous wall extending upwardly from the hollow radially arrayed arms, the continuous wall being radially inwardly centered over the hollow radially arrayed arms.

* * * * *